US007856972B2

(12) United States Patent
Lee et al.

(10) Patent No.: US 7,856,972 B2
(45) Date of Patent: Dec. 28, 2010

(54) APPARATUS FOR VENTILATION IN A RADIATION GAS RANGE

(75) Inventors: Dae Rae Lee, Gyeongsangnam-do (KR); Dae Hee Jung, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 744 days.

(21) Appl. No.: 10/533,665

(22) PCT Filed: Dec. 9, 2003

(86) PCT No.: PCT/KR03/02697

§ 371 (c)(1),
(2), (4) Date: May 3, 2006

(87) PCT Pub. No.: WO2004/053396

PCT Pub. Date: Jun. 24, 2004

(65) Prior Publication Data

US 2006/0254574 A1 Nov. 16, 2006

(30) Foreign Application Priority Data

Dec. 12, 2002 (KR) ..... 10-2002-0079237

(51) Int. Cl.
*F24C 3/00* (2006.01)
*F24C 15/10* (2006.01)

(52) U.S. Cl. ..... 126/39 J; 126/39 H; 126/214 R

(58) Field of Classification Search ..... 126/39 K, 126/39 R, 15 R, 214 R, 39 J, 39 N, 39 H, 126/39 B, 299 D, 21 R, 152 R, 312, 301, 126/303, 299 R See application file for complete search history.

(56) References Cited

U.S. PATENT DOCUMENTS 3,633,562 A * 1/1972 Morse et al. ..... 126/39 J (Continued)

FOREIGN PATENT DOCUMENTS

CN 2428707 5/2001

(Continued)

OTHER PUBLICATIONS

European Office Action dated Dec. 22, 2006.

(Continued)

*Primary Examiner*—Kenneth B Rinehart
*Assistant Examiner*—Daniel A Bernstein
(74) *Attorney, Agent, or Firm*—KED & Associates LLP

(57) ABSTRACT

An exhaust system in a radiation gas range is provided that includes a housing having exhaust openings in a rear part for discharge of exhaust gas, a sheet of glass on top of the housing for transmission of radiant heat to an object placed thereon, front and rear burner housings in contact with a bottom surface of the sheet of glass for forming spaces to burn mixed gas thereon, front radiation gas burners in lower parts of the front burner housings, respectively, each burning mixed gas at a surface of a radiation body to generate a radiation energy, rear radiation gas burners in lower parts of the front burner housings, respectively, each burning mixed gas at a surface of a radiation body to generate a radiation energy, and an exhaust duct in lower parts of, and in communication with the front and/or rear burner housings that discharges exhaust gas from the front and rear radiation burners toward the exhaust openings.

2 Claims, 13 Drawing Sheets

U.S. PATENT DOCUMENTS

| | | | | |
|---|---|---|---|---|
| 3,785,364 | A * | 1/1974 | Reid et al. | 126/39 J |
| 4,375,802 | A * | 3/1983 | Wallasvaara | 126/21 A |
| 4,951,646 | A * | 8/1990 | Diekmann et al. | 126/39 J |
| 5,139,007 | A * | 8/1992 | Bertomeu Martinez | 126/39 J |
| 5,509,403 | A * | 4/1996 | Kahlke et al. | 126/39 E |
| 6,067,980 | A * | 5/2000 | Kahlke et al. | 126/214 R |
| 6,230,701 | B1 * | 5/2001 | Schultheis et al. | 126/39 J |
| 6,234,161 | B1 * | 5/2001 | Levi et al. | 126/21 R |
| 2006/0048767 | A1 * | 3/2006 | Lee et al. | 126/214 R |
| 2006/0070616 | A1 * | 4/2006 | Lee et al. | 126/299 D |

FOREIGN PATENT DOCUMENTS

| | | |
|---|---|---|
| EP | 0 627 599 A2 | 12/1994 |
| EP | 1 573 251 B1 | 9/2005 |

OTHER PUBLICATIONS

Chinese Patent Gazette dated Jul. 16, 2008.

* cited by examiner

APPARATUS FOR VENTILATION IN A RADIATION GAS RANGE

This application is a U.S. National Stage Application of International Application No. PCT/KR2003/002697 filed Dec. 9, 2003. The disclosures of the previous applications are incorporated by reference herein.

TECHNICAL FIELD

The present invention relates to a radiation gas ranges, and more particularly, to an exhaust system in a radiation gas range, for discharging exhaust gas from radiation burners to an outside of the radiation gas range.

BACKGROUND ART

In general, a gas range has a plurality of gas burners having fuel gas and air supplied thereto at the same time, to burn a mixed gas of the fuel gas and the air, for cooking food.

Recently, use of a gas oven range is increasing, which has a composite function of a gas range function for heating food placed on a gas burner, an oven function for heating, and cooking food put inside of an enclosed cooking space, and a grill function for grilling fish by means of heat convection.

FIG. 1 illustrates a perspective view of a related art gas oven range schematically, provided with an oven part 1 for making barbecue or baking bread by using vertical heat and heat convection, a grill part 2 over the oven part 1 for grilling fish brown by using heat convection, a top burner part 3 over the grill part 2 for heating food or a container having the food placed therein, and a back guard part 4 for discharging exhaust gas from the oven part 1, the grill part 2, and the top burner part 3.

There are a plurality of gas burners 3*a* exposed to an outside of the range on the top burner part 3 for burning a mixed gas of the fuel gas supplied from an outside of the range and air, to heat food.

In the meantime, the related art gas oven range has problems in that the flame from the burner 3*a* of the top burner part 3, exposed to the outside of the range, always has fire hazard, soup of food, overflowed from cooking container, is liable to extinguish fire, imperfect combustion may be caused by flame holes blocked with the overflowed soup and foreign matters, it is difficult to clean as disassemble relevant parts of the gas burner is required for removal of foreign matters.

To solve the foregoing problems in the related art, radiation gas burners have been developed, in which a ceramic glass is provided on top of the top burner part of the gas oven range, or on top of the gas range, and a plurality of radiation gas burners are provided under the ceramic glass concealed from an outside of the range, for heating food with radiation heat through the ceramic glass without direct touch of the flame from the radiation gas burners to the food.

However, the related art radiation gas range has a problem in that a high temperature exhaust gas staying in the range due to the concealed structure of the radiation gas burners that impedes natural discharge of the exhaust gas acts as a thermal load, that impedes smooth supply of external air to an inside of the radiation gas burners, and results in failure in proper combustion.

DISCLOSURE OF INVENTION

An object of the present invention, designed for solving the foregoing problems, is to provide an exhaust system in a radiation gas range, for smooth discharge of exhaust gas produced from a plurality of radiation gas burners in burning the gas.

To achieve the object of the present invention, there is provided an exhaust system in a radiation gas range including a housing having exhaust openings in a rear part for discharge of exhaust gas, a sheet of glass on top of the housing for transmission of radiant heat to a heating object placed thereon, front and rear burner housings in contact with a bottom surface of the sheet of glass for forming spaces to burn mixed gas therein, front radiation gas burners in lower parts of the front burner housings respectively each for burning mixed gas at a surface of a radiation body to generate a radiation energy, rear radiation gas burners in lower parts of the front burner housings 32 respectively each for burning mixed gas at a surface of a radiation body to generate a radiation energy, and an exhaust duct in lower parts of, and in communication with the front and/or rear burner housings for discharging exhaust gas from the front and rear radiation burners toward the exhaust openings.

Thus, the present invention can guide the exhaust gas from the front radiation gas burners and the rear radiation gas burners to the exhaust openings through the exhaust duct smoothly, and discharges therefrom.

In other aspect of the present invention, there is provided an exhaust system in a radiation gas range including a housing having exhaust openings in a rear part for discharge of exhaust gas, a sheet of glass on top of the housing for transmission of radiant heat to a heating object placed thereon, two front burner housings, and two rear burner housings in contact with a bottom surface of the sheet of glass for forming spaces to burn mixed gas therein, two front radiation gas burners, and two rear radiation gas burners in lower parts of the front, and rear burner housings respectively each for burning mixed gas at a surface of a radiation body to generate a radiation energy, a first exhaust duct in lower parts of, and to pass through spaces between the front burner housings, and between the rear burner housings in communication with the front burner housings, for discharging exhaust gas from the front radiation burners toward the exhaust openings, and a second exhaust duct, inside of, and separate from the first exhaust duct in communication with the rear burner housings.

Thus, as the exhaust gas from the front, and rear radiation gas burners can be discharged separately, the present invention can discharge the exhaust gas smoother than a case the exhaust gas is discharged together, minimizes an influence of one side exhaust gas to the other side exhaust gas to make smooth air introduction into the radiation gas burners.

In another aspect of the present invention, there is provided an exhaust system in a radiation gas range including a housing having exhaust openings in a rear part for discharge of exhaust gas, a sheet of glass on top of the housing for transmission of radiant heat to a heating object placed thereon, two front, and rear burner housings in contact with a bottom surface of the sheet of glass for forming spaces to burn mixed gas therein, two front radiation gas burners, and two rear radiation gas burners in lower parts of the front, and rear burner housings respectively each for burning mixed gas at a surface of a radiation body to generate a radiation energy, a central exhaust duct between lower parts of, and in communication with the front burner housings, for guiding exhaust gas from the front radiation gas burners to the exhaust openings, a partition wall at a central part of the central exhaust duct for dividing the central exhaust duct into two parts, one of which is in communication with the front burner housing on a left side, and the other one of which is in communication with the front burner housing on a right side, and two rear exhaust ducts in communication with rear parts of the rear burner housings individually, for discharging exhaust gas from the front radiation gas burners and the rear radiation gas burners toward the exhaust openings.

Thus, the exhaust system in a radiation gas range of this embodiment permits to maximize an exhaust gas discharge performance since exhaust gas from the radiation gas burners is discharged independently.

In further aspect of the present invention, there is provided an exhaust system in a radiation gas range including a housing having exhaust openings in a rear part for discharge of exhaust gas, a sheet of glass on top of the housing for transmission of radiant heat to a heating object placed thereon, front and rear burner housings in contact with a bottom surface of the sheet of glass for forming spaces to burn mixed gas therein, front radiation gas burners in lower parts of the front burner housings respectively each for burning mixed gas at a surface of a radiation body to generate a radiation energy, rear radiation gas burners in lower parts of the front burner housings 32 respectively each for burning mixed gas at a surface of a radiation body to generate a radiation energy, and an exhaust duct formed to adjoin to a bottom of the sheet of glass, in communication with one side part of each of the front and/or rear burner housings for discharging exhaust gas from the front, and rear radiation burners toward the exhaust openings.

Thus, the present invention permits smoother discharge of the exhaust gas from the burner housings to the exhaust duct since the exhaust duct is in communication with one side part of each of the front, and rear burner housings, directly.

In another embodiment of the present invention, the exhaust duct includes a central exhaust duct formed at a central part of the housing to adjoin to a bottom of the sheet of glass, and to pass between the front burner housings, and between the rear burner housings, and in communication with one side part of each of the front burner housings, for guiding exhaust gas from the front radiation gas burners to the exhaust openings, and two rear exhaust ducts on both sides of a rear part of the central duct in communication with rear parts of the rear burner housings individually, for discharging exhaust gas from the rear radiation gas burners toward the exhaust openings.

Thus, the present invention can improve the exhaust performance further since the exhaust gas from the front burner housing, and the exhaust gas from the rear burner housing are discharged, separately.

BRIEF DESCRIPTION OF DRAWINGS

The accompanying drawings, which are included to provide a further understanding of the invention, illustrate embodiments of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. For better understanding, partition walls that separate front and/or rear burner housings in left/right sides in FIGS. 3 to 13 are not shown in the following embodiments.

Figure 1:
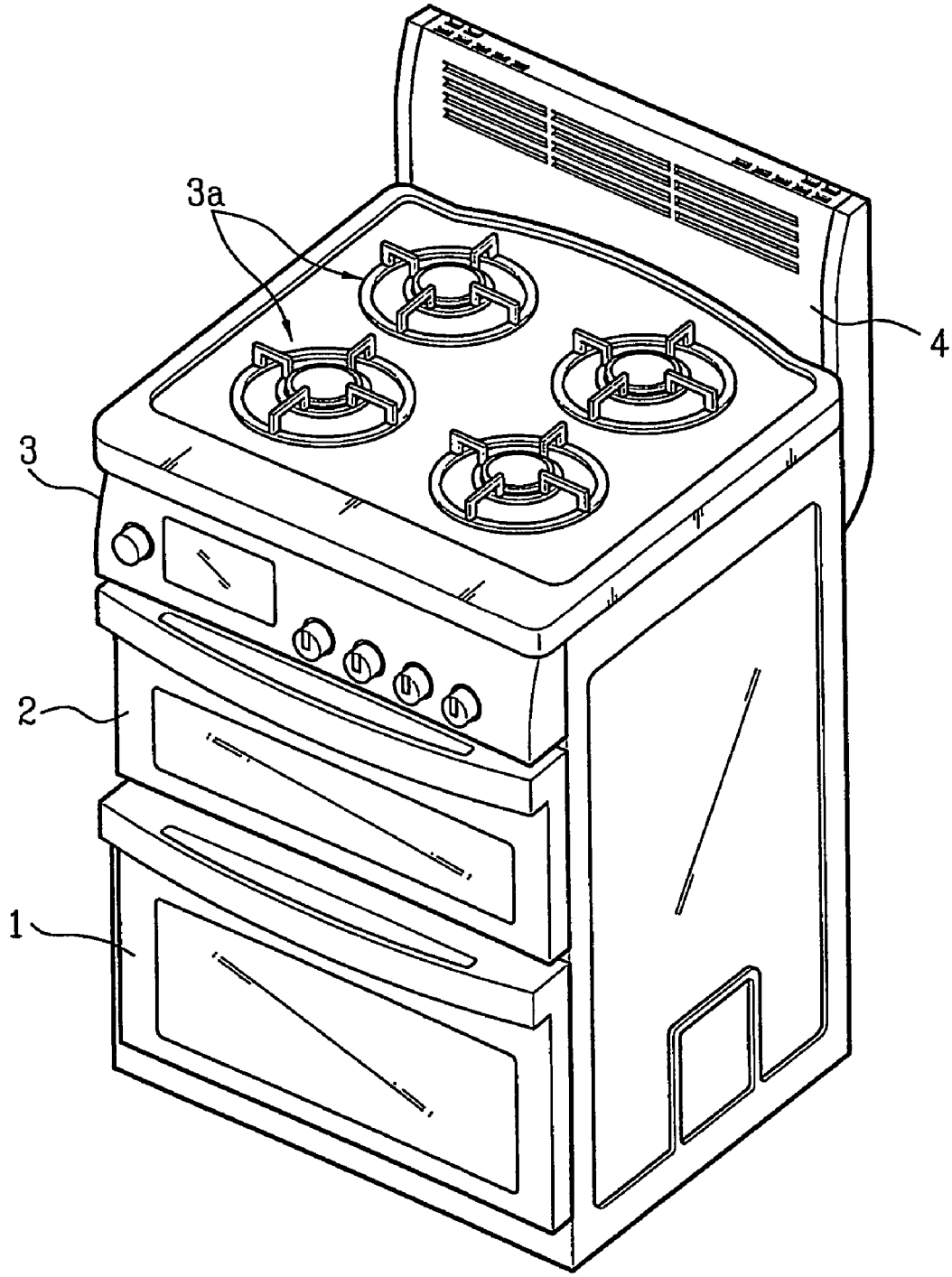
FIG. 1 illustrates a perspective view of a related art gas oven range.
Figure 2:
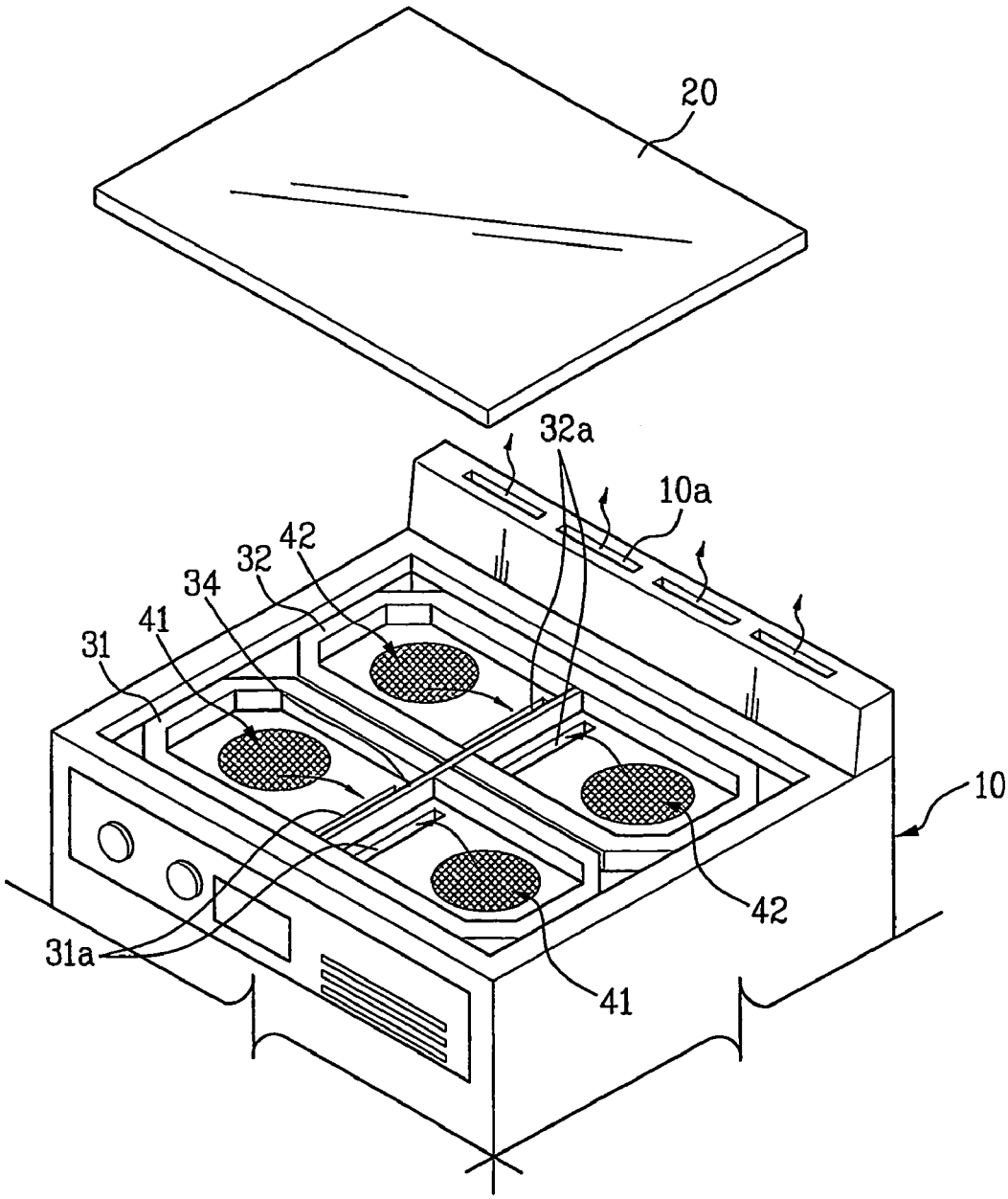
FIG. 2 illustrates a disassembled perspective view of a radiation gas range in accordance with a preferred embodiment of the present invention, schematically.
Figure 3:
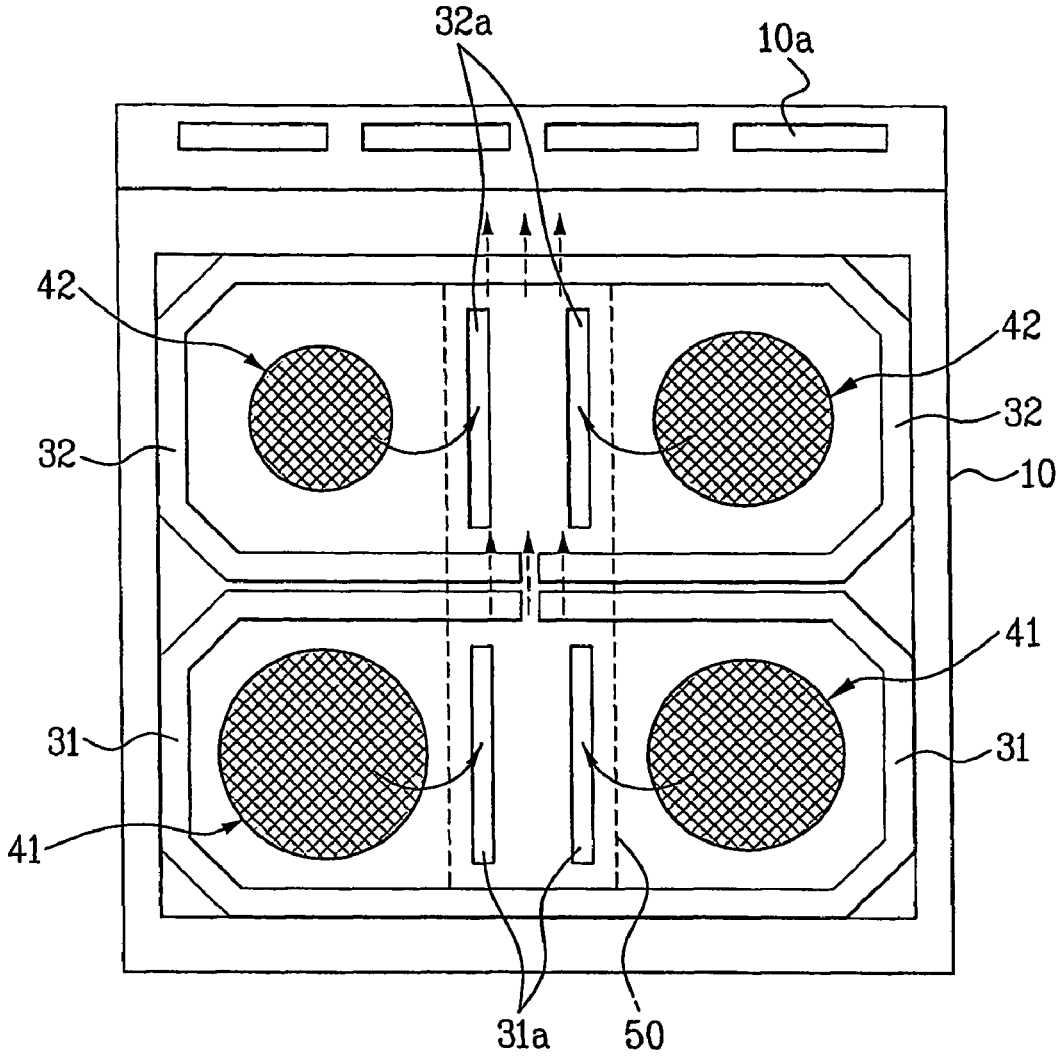
FIG. 3 illustrates a plan view of the exhaust system in the radiation gas range in FIG. 2, schematically.
Figure 4:
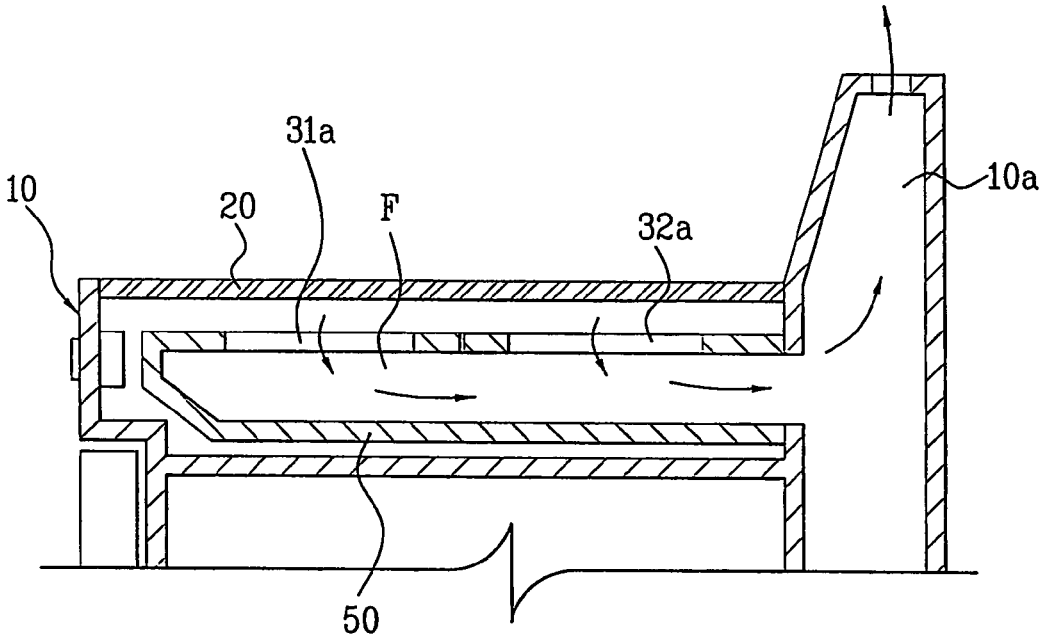
FIG. 4 illustrates a section of the exhaust system in the radiation gas range in FIG. 2, schematically.

FIGS. 2 and 4 illustrate one embodiment of a radiation gas range of the present invention, including a housing 10 having exhaust openings 10*a* in a rear part for discharge of exhaust gas, a ceramic glass 20 on top of the housing to enclose the top for placing a heating object thereon, front and rear burner housings 31, and 32 in contact with a bottom surface of the ceramic glass 20, front radiation gas burners 41 arranged in lower parts of the front burner housings respectively 31 each for burning mixed gas at a surface of a radiation body to generate a radiation energy, rear radiation gas burners 42 arranged in lower parts of the front burner housings 32 each for burning mixed gas at a surface of a radiation body to generate a radiation energy, and an exhaust duct 50 in lower parts of the front and rear burner housings 31 and 32 along a central part of the housing 10 to form an exhaust passage 'F' for discharging exhaust gas from the front and rear burners 41, and 42 toward the exhaust openings 10*a* in the rear part of the housing 10.

There are two sets of each of the front, and rear burner housings 31, and 32, and two sets of each of the front, and rear radiation gas burners provided in left/right sides in the range.

There are front inlets 31*a* in bottoms of the front burner housings 31 for introduction of the exhaust gas into the exhaust duct 50 from the front radiation gas burners 41, and rear inlets 32*a* in bottoms of the rear burner housings 32 for introduction of the exhaust gas into the exhaust duct 50 from the rear radiation gas burners 42.

There are partition walls 34 between the front burner housings 31, and between the rear burner housings 32 for separating the front burner housings 31, and the rear burner housings 32 from each other.

The operation of the radiation gas range of the present invention will be described.

When a user places a cooking container on the ceramic glass 20, and operates a flame control knob 11, flame is produced from surfaces of the front, and rear radiation gas burners 41, and 42 to take place a surface combustion as a mixed gas of fuel gas and air is supplied to the front and rear radiation gas burner 41, and 42, such that radiant heat is transmitted to the cooking container through the ceramic glass 20, to heat the cooking container.

The exhaust gas produced in the front and rear burner housings 31 and 32 by combustion at the front, and rear radiation gas burners 41, and 42 are introduced into the exhaust duct 50 through the front, and rear inlets 31*a*, and 32*a*, and flows to the exhaust openings 10*a* in the rear part of the housing 10, and discharged to an outside of the range.

Figure 5:
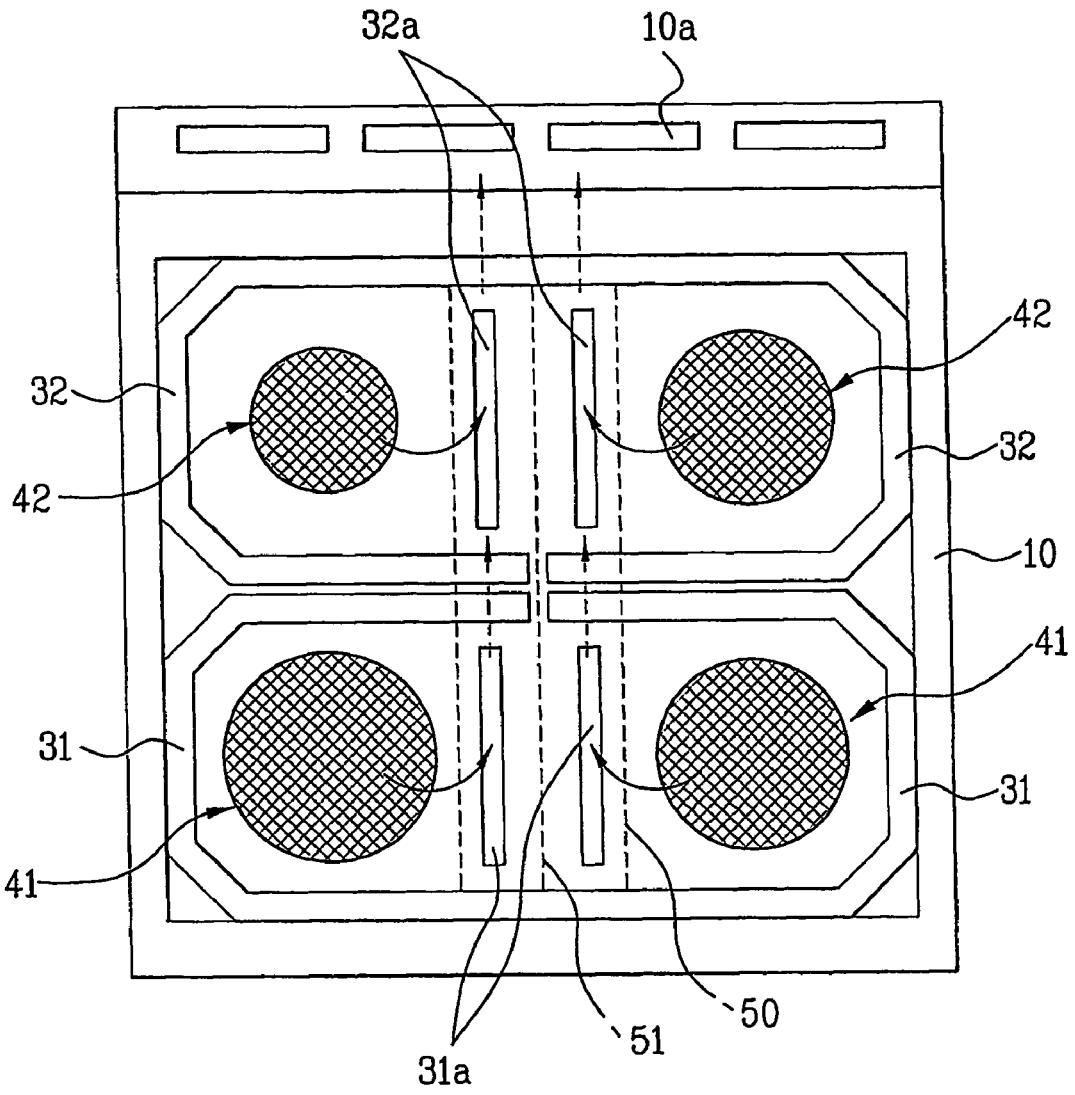
FIG. 5 illustrates a plan view of an exhaust system in a radiation gas range in accordance with a second preferred embodiment of the present invention, schematically.

In the meantime, in a first preferred embodiment of the exhaust system in a radiation gas range, even though it is designed that all exhaust from the radiation gas burners 41, and 42 is discharged through one exhaust duct 50, alike the exhaust system in a radiation gas range in accordance with a second preferred embodiment of the present invention as shown in FIG. 5, a partition wall 51 may be provided at a center of the exhaust duct 50 that divides the exhaust duct 50 into left, and right side parts, with the left side part in communication with the front, and rear burner housings 31, and 32 on the left side, and the right side part in communication with the front, and rear burner housings 31, and 32 on the right side.

In this case, the exhaust gas from the left side front, and rear radiation gas burners 41, and 42 is introduced into the left side of the exhaust duct 50 through the left side front, and rear inlets 31*a*, and 32*a*, and therefrom discharged through the exhaust openings 10*a*, and the exhaust gas from the right side front, and rear radiation gas burners 41, and 42 is introduced into the right side of the exhaust duct 50 through the right side front, and rear inlets 31*a*, and 32*a*, and therefrom discharged through the exhaust openings 10*a*.

Therefore, the exhaust system of this embodiment can enhance an exhaust performance in a case many radiation gas burners are used at the same time because the exhaust gas is discharged separated in left and right sides.

Figure 6:
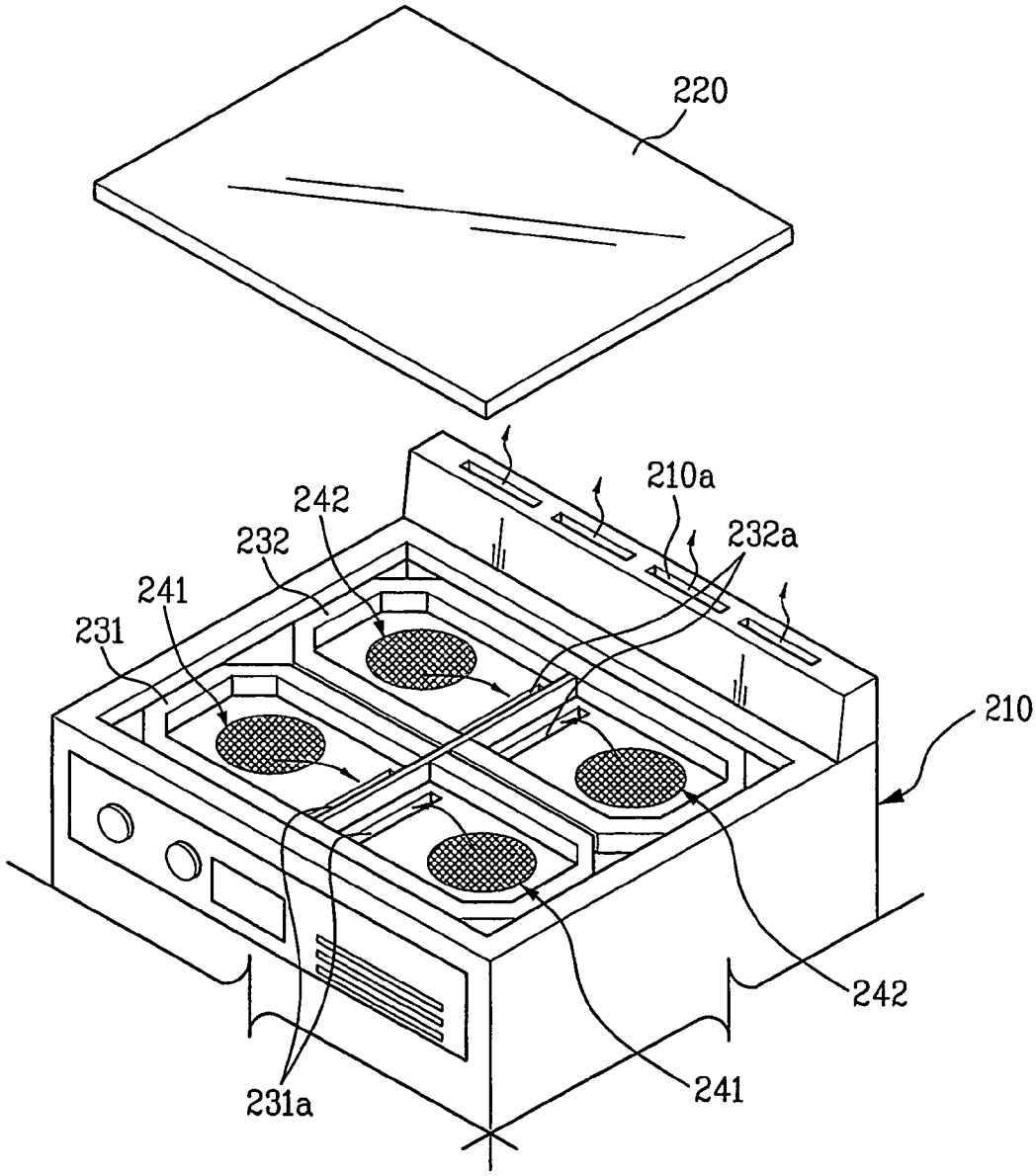
FIG. 6 illustrates a perspective view of an exhaust system in a radiation gas range in accordance with a third preferred embodiment of the present invention, schematically.
Figure 7:
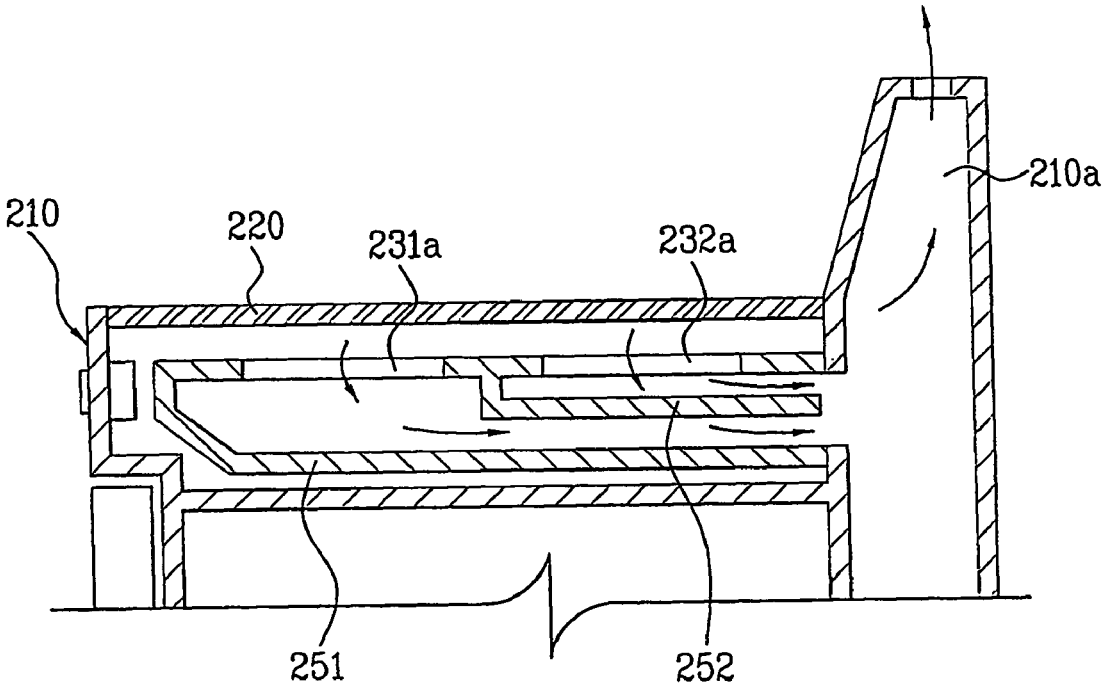
FIG. 7 illustrates a section of key parts of the exhaust system of the radiation gas range in FIG. 6.

FIGS. 6 or 7 illustrate an exhaust system in a radiation gas range in accordance with a third preferred embodiment of the present invention, including, alike the exhaust system in a radiation gas range in accordance with a first preferred embodiment of the present invention, a housing 210 having exhaust openings 10*a* in a rear part for discharge of exhaust gas, a ceramic glass 220 on top of the housing to enclose the top for placing a heating object thereon, two front and rear burner housings 231, and 232 in contact with a bottom surface of the ceramic glass 220, two sets of front radiation gas burners 241 arranged in a lower part of the front burner housing 231 each for burning mixed gas at a surface of a radiation body to generate a radiation energy, and two sets of rear radiation gas burners 242 arranged in the lower part of the front burner housing 232 each for burning mixed gas at a surface of a radiation body to generate a radiation energy, Also, there is a first exhaust duct 251 in lower parts of the front and rear burner housings 231 and 232 along a central part of the housing 210, and a second exhaust duct 252 inside of, and separate from the first exhaust duct 251, having one end in communication with the exhaust openings 210*a*.

It is preferable that a sectional area of the second exhaust duct 252 is smaller than ½ of a sectional area of the first exhaust duct 251, for smooth discharge of the exhaust gas from the first exhaust duct 251 toward the exhaust openings 210*a*.

There are front inlets 231*a* in one side parts of the front burner housings 231 for introduction of the exhaust gas from the front radiation gas burners 241 into the first exhaust duct 251, and rear inlets 232*a* in one side parts of the rear burner housings 232 for introduction of the exhaust gas from the front radiation gas burners 242 into the second exhaust duct 252.

According to this, the exhaust gas produced in the front burner housings 231 by combustion at the front radiation gas burners 241 is introduced into the first exhaust duct 251 through the front inlets 231*a*, and therefrom discharged through the exhaust openings 210*a*, and the exhaust gas produced in the rear burner housings 232 by combustion at the rear radiation gas burners 242 is introduced into the second exhaust duct 252 through the rear inlets 232*a*, and therefrom discharged through the exhaust openings 210*a*.

Figure 8:
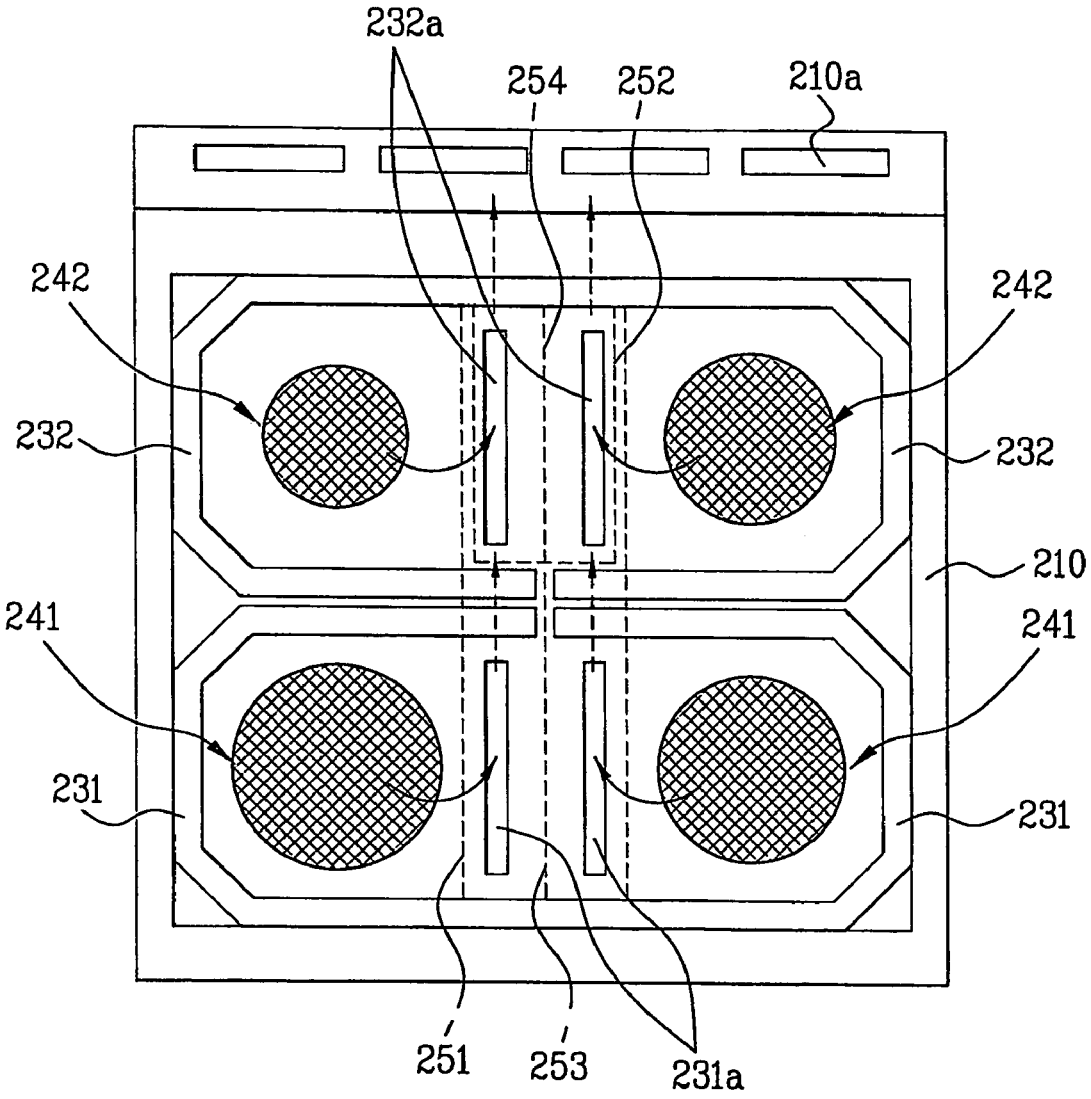
FIG. 8 illustrates a plan view of an exhaust system in a radiation gas range in accordance with a fourth preferred embodiment of the present invention, schematically.

In the meantime, even though the exhaust gas from the front, and rear radiation gas burners 241, and 242 is discharged separately in this embodiment, different from this, alike the exhaust system in a radiation gas burner in accordance with a fourth preferred embodiment of the present invention as shown in FIG. 8, by forming a first partition wall 253 at a center part of the first exhaust duct 251 for dividing the first exhaust duct 251 into left and right side part, and a second partition wall 254 at a center part of the second exhaust duct 252 for dividing the second exhaust duct 252 into left and right side part, the exhaust gas from the four front, and rear radiation gas burners 241, and 242 can be discharged independently.

Of course, the first, and second partition walls 253, and 254 can be formed selectively as required.

Figure 9:
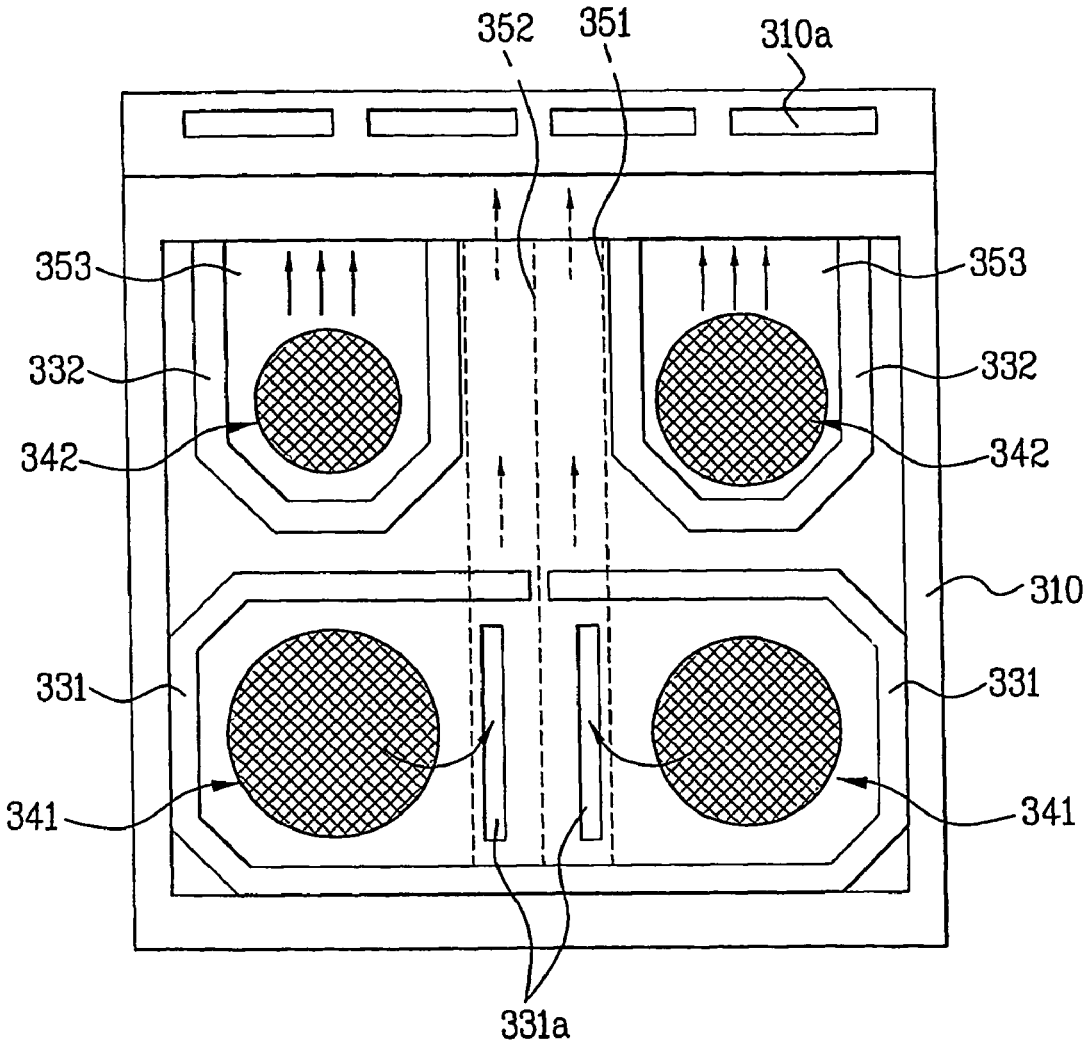
FIG. 9 illustrates a plan view of an exhaust system in a radiation gas range in accordance with a fifth preferred embodiment of the present invention, schematically.

FIG. 9 illustrates an exhaust system in a radiation gas range in accordance with a fifth preferred embodiment of the present invention, including each two front burner housings 331 and front radiation gas burners 341 in a front part of a housing 310, and each two rear burner housings 332 and rear radiation gas burners 342 in a rear part of the housing 310.

There is a central exhaust duct 351 along a central part of the housing 10 under the front burner housing 31. There is a partition wall 352 at a central part of the central exhaust duct 351 for dividing the central exhaust duct 351 into left, and right side parts, and there is a front inlet 331*a* in one side part of each of the front burner housings 331, in communication with the left, and right side parts of the divided central exhaust duct 351.

Each of the rear housings 332 is in communication with the exhaust opening 310*a* through a rear exhaust duct 353. Like the central exhaust duct 351, though the rear exhaust duct 353 may be formed under the rear burner housing 32, it is preferable that the rear exhaust duct 353 is formed under, and to adjoin to the ceramic glass such that the rear exhaust duct 353 is connected to a rear part of the rear burner housing 32.

Accordingly, the exhaust system of the embodiment permits that the exhaust gas from the front radiation gas burns 341 is introduced into the left and right parts of the central exhaust duct 351 through the front inlets 331*a* respectively, and discharged to the exhaust openings 310*a* separately, and the exhaust gas from the rear radiation gas burners 342 is discharged through the rear exhaust ducts 353, independently.

That is, the exhaust gas from the radiation gas burners 341, and 342 is discharged through the central duct 351, and the rear exhaust ducts 353, independently.

Figure 10:
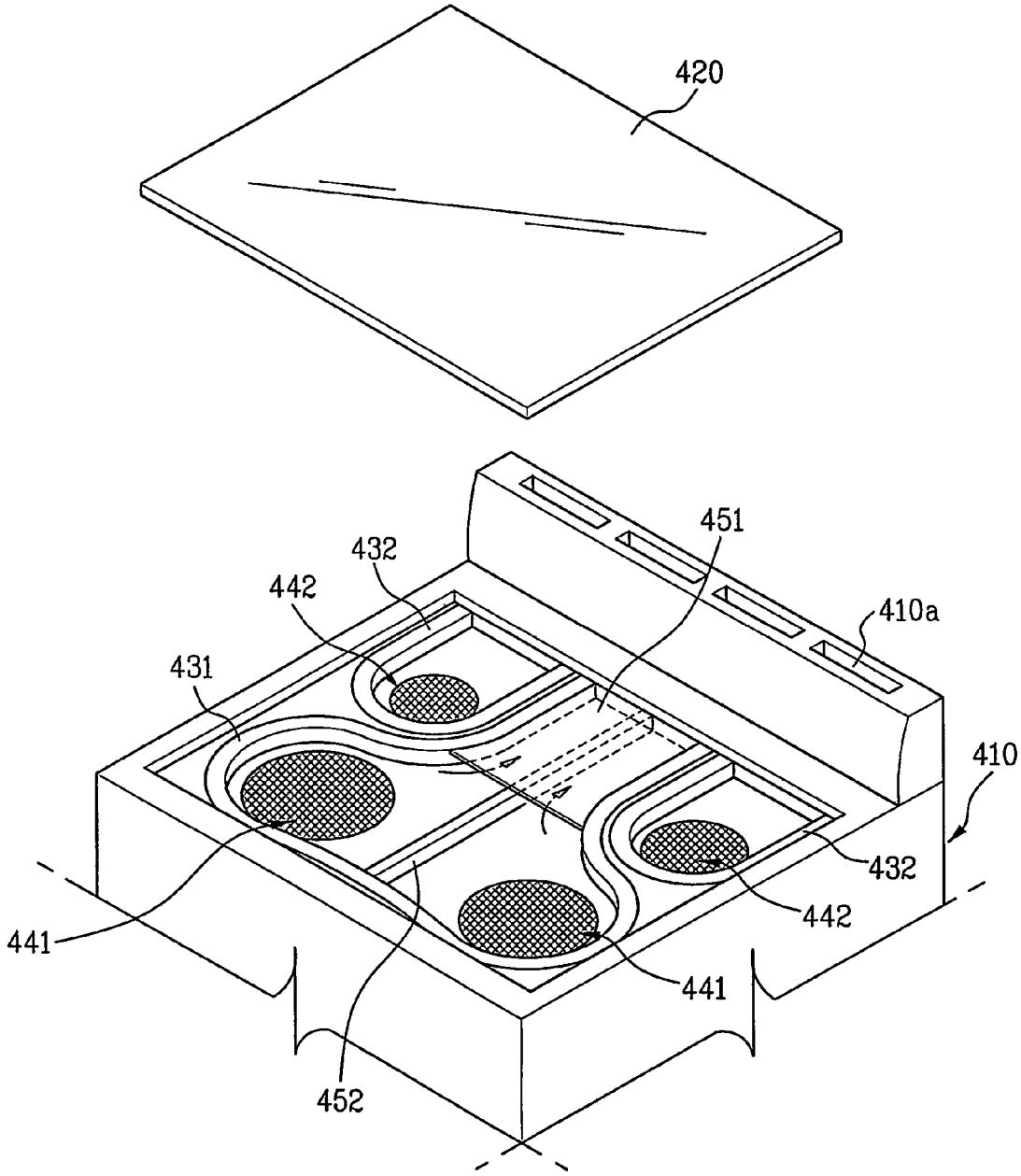
FIG. 10 illustrates a perspective disassembled view of an exhaust system in a radiation gas range in accordance with a sixth preferred embodiment of the present invention, schematically.
Figure 11:
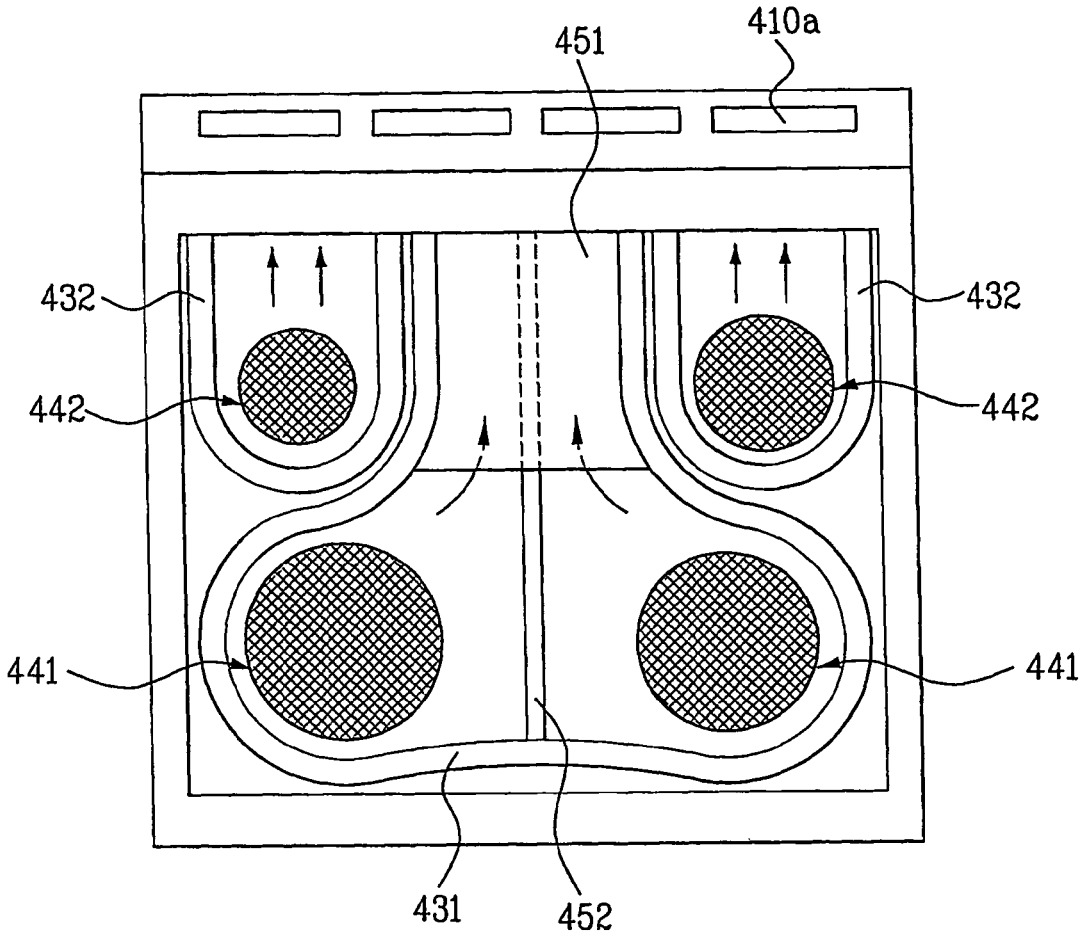
FIG. 11 illustrates a plan view of the radiation gas range in FIG. 10.

In the meantime, FIG. 10 or 11 illustrates other embodiment of the radiation gas range of the present invention, including exhaust openings 410*a* in a rear part of the housing 410 for discharging exhaust gas to an outside of the range, a ceramic glass 420 on top of the housing 410 for transmission of radiant heat to a cooking container placed thereon, and a plurality of front, and rear burner housings 431, and 432 under, and enclosed with the ceramic glass 420 in contact with the ceramic glass 420.

There are two front radiation gas burners 441 under the front burner housings 431 each for burning mixed gas at a surface of a radiation body to generate a radiation energy, and two rear radiation gas burners 442 under the rear burner housings 432 each for burning mixed gas at a surface of a radiation body to generate a radiation energy.

There is a central exhaust duct 451 under, and to adjoin to the ceramic glass 420 in communication with one side part of each of the front burner housings 431. There is a partition wall 452 at central parts of the central exhaust duct 451 and the front burner housings 431 for dividing the central exhaust duct 451 in left and right side parts.

There is a rear exhaust duct 455 in a rear part of each of the rear burner housings 32 in communication with rear exhaust openings 410*a*, individually.

According to the exhaust system in a radiation gas range of the foregoing embodiment, the exhaust gas from the left and right side front burner housings 431 is separated in left, and right sides along the central exhaust duct 451 directly, and discharged to an outside of the range through the exhaust openings 410*a*, and the exhaust gas from the rear burner housing 532 flows to the exhaust openings 410*a* through the rear exhaust ducts 455, and therefrom discharged to an outside of the range.

Figure 12:
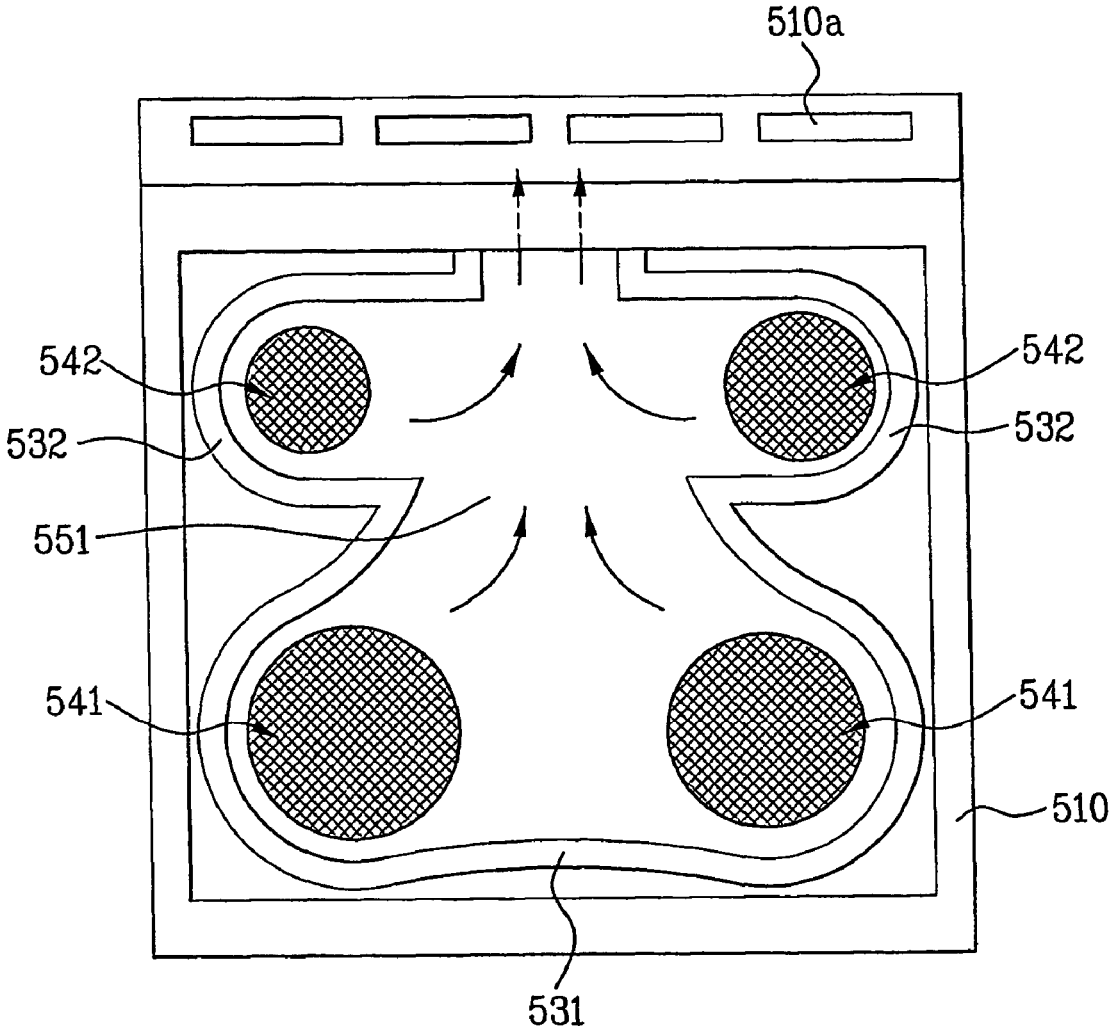
FIG. 12 illustrates a plan view of an exhaust system in a radiation gas range in accordance with a seventh preferred embodiment of the present invention, schematically.

In the meantime, as shown in FIG. 12, though the exhaust system of the radiation gas range discharges exhaust from the burner housings 410 independently, different from this, one exhaust duct 551 may be formed under the ceramic glass (see FIG. 10) so as to be in communication with one side of each of the front and rear burner housings 531, and 532 at the same time.

Figure 13:
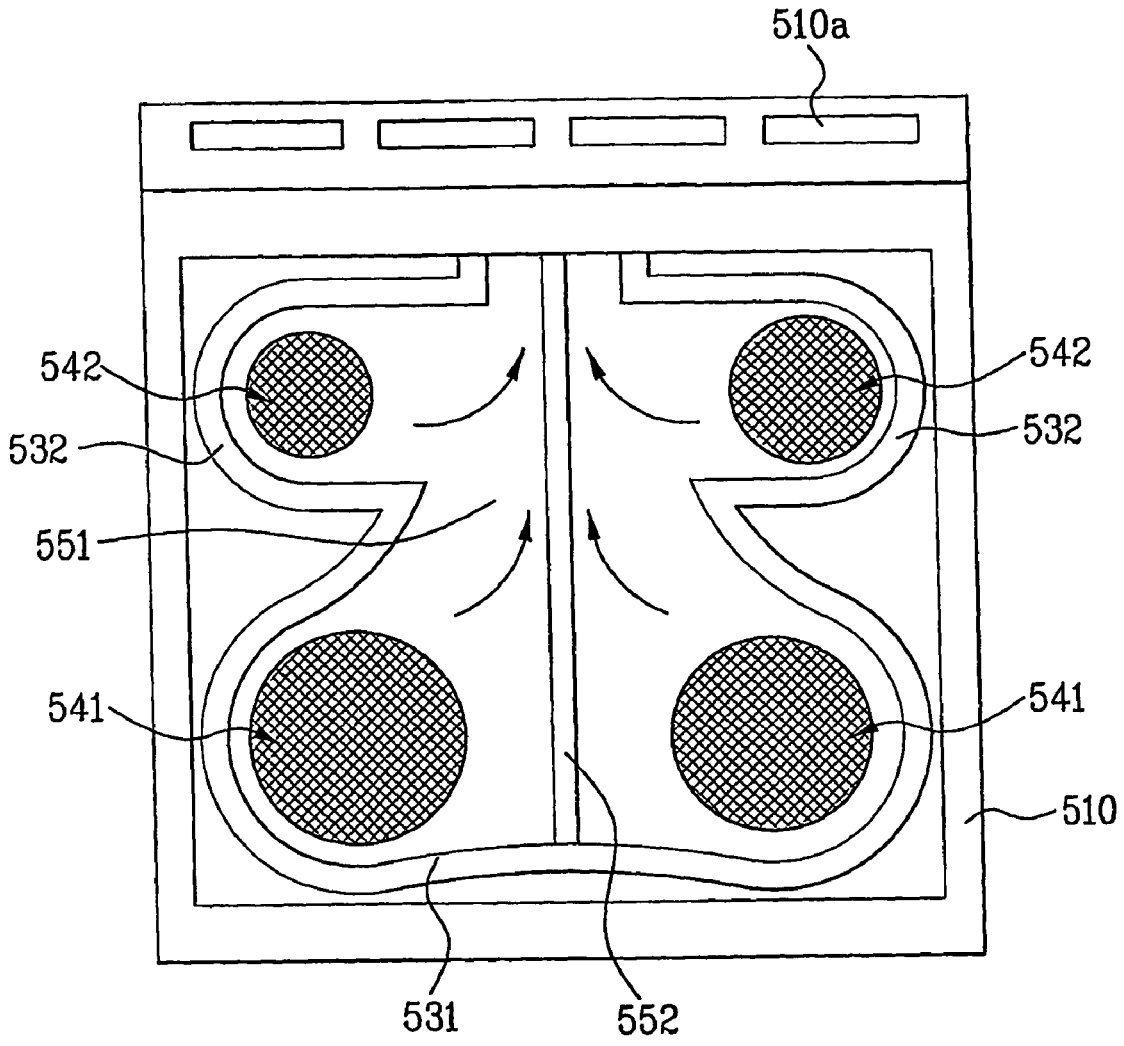
FIG. 13 illustrates a plan view of an exhaust system in a radiation gas range in accordance with an eighth preferred embodiment of the present invention, schematically.

Moreover, referring to FIG. 13, one exhaust duct 551 may be formed under the ceramic glass (see FIG. 10) so as to be in communication with one side of each of the front and rear burner housings 531, and 532 at the same time, and a partition wall 552 is arranged at a central part of the exhaust duct 551 to divide the exhaust duct 551 into left, and right side parts, such that the front burner housing 531 and the rear burner housing 532 on the left are in communication with the left side part of the exhaust duct 551, and the front burner housing 531 and the rear burner housing 532 on the right are in communication with the right side part of the exhaust duct 551.

Therefore, in this case, the exhaust gas from the front burner housing 531 and the rear burner housing 532 on the left flows toward the exhaust openings 510*a* through the left side part of the exhaust duct 551, and therefrom discharged to an outside of the range, and the exhaust gas from the front burner housing 531 and the rear burner housing 532 on the right flows toward the exhaust openings 510*a* through the right side part of the exhaust duct 551, and therefrom discharged to an outside of the range.

Thus, the exhaust system in a radiation gas range of the present invention permits fast drop of a thermal load on each of the radiation gas burners, and smooth introduction of external air, to improve a combustion efficiency, because the exhaust gas from the plurality of radiation gas burners can be discharged smoothly through the exhaust ducts.

Particularly, when the burner housings of the radiation gas burners are in communication with the exhaust ducts independently, to eliminate a possibility that the exhaust gas from one radiation gas burner is not affected by the exhaust gas from another radiation gas burner, smoother discharge of the exhaust can be achieved.

INDUSTRIAL APPLICABILITY

As has been described, the exhaust system in a radiation gas range of the present invention can be applied to any ranges that cook by using gas burning, favorably.

What is claimed is:

1. An exhaust system in a radiation gas range, the exhaust system comprising:

a housing having exhaust openings in a rear part that discharge exhaust gas;

a sheet of glass on top of the housing that transmits radiant heat to an object placed thereon;

two front burner housings and two rear burner housings in contact with a bottom surface of the sheet of glass that form spaces to burn mixed gas therein;

two front radiation gas burners and two rear radiation gas burners in lower parts of the front and rear burner housings, respectively, each burning mixed gas at a surface of a radiation body to generate a radiation energy;

a first exhaust duct in lower parts of, and that passes through spaces between the front burner housings and between the rear burner housings in communication with the front burner housings, that discharges exhaust gas from the front radiation burners toward the exhaust openings;

a second exhaust duct formed inside of, and separate from, the first exhaust duct in communication with the rear burner housings;

a first partition wall at a central part of the first exhaust duct, that divides the first exhaust duct into two parts, one of which communicates with the front burner housing on a left side, and the other one of which communicates with the front burner housing on a right side; and a second partition wall at a central part of the second exhaust duct, that divides the second exhaust duct into two parts, one of which communicates with the rear burner housing on a left side, and the other one of which communicates with the rear burner housing on a right side, wherein the two front burner housings and two rear burner housings comprise front inlets and rear inlets at one side part of the two front burner housings and two rear burner housings, respectively, and the first exhaust duct and second exhaust duct are arranged at lower parts of the front inlets and the rear inlets.

2. The exhaust system as claimed in claim 1, wherein the second exhaust duct has a sectional area smaller than ½ of a sectional area of the first exhaust duct.

* * * * *